US009429159B2

(12) United States Patent
Geue et al.

(10) Patent No.: US 9,429,159 B2
(45) Date of Patent: Aug. 30, 2016

(54) PUMP

(71) Applicant: Hella KGaA Hueck & Co., Lippstadt (DE)

(72) Inventors: Ingo Geue, Bad Sassendorf (DE); Theodor Hüser, Geseke (DE); Dietmar Rech, Oberwesel (DE); Thomas Valeiras Fernandez, Lippstadt (DE)

(73) Assignee: HELLA KGAA HUECK & CO., Lippstadt (DE)

( * ) Notice: Subject to any disclaimer, the term of this patent is extended or adjusted under 35 U.S.C. 154(b) by 160 days.

(21) Appl. No.: 14/102,039

(22) Filed: Dec. 10, 2013

(65) Prior Publication Data

US 2014/0161640 A1 Jun. 12, 2014

(30) Foreign Application Priority Data

Dec. 11, 2012 (DE) ..... 10 2012 112 069

(51) Int. Cl.

| | |
|---|---|
| ***F04C 29/06*** | (2006.01) |
| ***F04C 29/00*** | (2006.01) |
| *F04C 25/02* | (2006.01) |
| *F04C 18/344* | (2006.01) |

(52) U.S. Cl.

CPC ..... *F04C 29/066* (2013.01); *F04C 29/0092* (2013.01); *F04C 29/065* (2013.01); *F04C 29/068* (2013.01); *F04C 18/344* (2013.01); *F04C 25/02* (2013.01); *F04C 2240/30* (2013.01)

(58) Field of Classification Search

CPC F04B 39/0055; F04B 39/0061; F04B 39/16; F04C 29/065; F04C 29/066; F04C 29/068; F04C 29/0092; F04C 18/344; F04C 25/02; F04C 2240/30

USPC ..... 417/312, 313, 410.3

See application file for complete search history.

(56) References Cited

U.S. PATENT DOCUMENTS

| | | | | | |
|---|---|---|---|---|---|
| 2,720,935 | A * | 10/1955 | Lysholm | F01N 1/02 | 181/257 |
| 4,123,201 | A * | 10/1978 | Andriulis | F04C 18/3441 | 417/204 |
| 4,623,304 | A * | 11/1986 | Chikada | F25B 31/026 | 417/312 |
| 4,890,691 | A * | 1/1990 | Ching-ho | F01N 1/083 | 181/264 |
| 4,958,990 | A * | 9/1990 | Gordon | F04B 39/0033 | 29/888.025 |
| 6,491,505 | B1 * | 12/2002 | Hueser | F04C 23/00 | 417/312 |
| 8,016,071 | B1 * | 9/2011 | Martinus | F04B 39/0061 | 181/268 |
| 8,500,417 | B2 * | 8/2013 | Han | F04B 37/14 | 181/229 |
| 8,550,208 | B1 * | 10/2013 | Potokar | F02K 3/075 | 181/212 |
| 2006/0056988 | A1 * | 3/2006 | Seok | F04B 39/0055 | 417/273 |
| 2008/0302596 | A1 * | 12/2008 | Harrington | F04B 39/0055 | 181/212 |

(Continued)

FOREIGN PATENT DOCUMENTS

| | | | |
|---|---|---|---|
| DE | 4239575 | C2 | 11/1995 |
| DE | 102006058978 | A1 | 6/2008 |
| DE | 102009056010 | A1 | 6/2011 |

*Primary Examiner* — Bryan Lettman
*Assistant Examiner* — David Brandt
(74) *Attorney, Agent, or Firm* — Husch Blackwell LLP

(57) ABSTRACT

A pump includes a pump chamber in which a rotor with gates is supported so that it can rotate, an electric motor for driving the rotor, a muffler that encloses a volume in the area of the pump chamber, wherein the volume is in active connection with an outlet port and a front muffler that is arranged within the muffler. To improve the service life and reliability of the pump in a vehicle with minimal installation expense, it is proposed that a filter is integrated into the front muffler.

7 Claims, 3 Drawing Sheets

(56) References Cited

U.S. PATENT DOCUMENTS

2010/0092320 A1* 4/2010 Duppert ..... F04C 18/0215
418/55.6
2010/0269797 A1* 10/2010 Prior ..... F02B 33/38
123/559.1
2010/0319798 A1* 12/2010 Lim ..... F04C 25/02
137/899
2013/0045126 A1* 2/2013 Huser ..... F04C 2/3446
418/181
2014/0161640 A1* 6/2014 Geue ..... F04C 29/066
417/312

* cited by examiner

PUMP

CROSS REFERENCE

This application claims priority to German Patent Application No. 10 2012 112069.2, filed Dec. 11, 2012.

TECHNICAL FIELD OF THE INVENTION

The invention relates to a pump with a pump chamber in which a rotor with gates is supported so that it can rotate, an electric motor for driving the rotor, a muffler that encloses a volume in the area of the pump chamber, wherein the volume is in active connection with an outlet opening and a front muffler that is arranged within the muffler.

BACKGROUND OF THE INVENTION

Such pumps are known and are also designated as vane cell pumps in their construction. They are used for feeding gases or fluids and are used, e.g., in motor vehicles preferably as vacuum pumps for engine management and/or for boosting the braking force.

In DE 10 2006 058 978 A1, a pump (vane cell pump) is described in which a pump chamber comprises a pump ring that is arranged between a base plate and a cover plate. For reducing noise, a muffler is provided, but there is no front muffler. So that the gates are not tilted during operation and gate fractures are prevented, inlet openings are chamfered in the base plate.

DE 10 2009 056 010 A1 discloses a vane cell pump according to the class in which a front muffler is arranged in a muffler. An outlet opening of the front muffler has a cross section that tapers in the direction of the outlet. This prevents losses in power while simultaneously providing effective noise reduction.

From DE 42 39 575 C2, a muffler for vane cell pumps is known that is divided into two parts. One part is the suction side and the other part is the exhaust side of the pump. A filter sieve is arranged in the other part, in order to keep particles generated during production away from sensitive loads. A front muffler is not provided.

In the prior art it is not known to protect the sensitive pump itself from particles with filters, in order to guarantee the reliability and service life of the pump. It is only known to suction air from locations at which a particle load is relatively low. For this purpose, corresponding lines that reduce the pump output and increase the installation expense are required in vehicles.

Therefore the problem of the invention is to create a pump whose service life and reliability are improved with low installation expense in a vehicle. At the same time, the pump should have good sound damping.

SUMMARY OF THE INVENTION

A filter is integrated into the front muffler. The front muffler is allocated to a pressure side of the pump, that is, when the pump is operating, the compressed air coming from the pump flows through the filter. When the pump is switched off, however, air flows back through a pressure port of the pump and through the pressure side back into the pump due to the low pressure on the suction side. In this way, particles contained in the air can be carried along and led into the pump chamber, where they can lead to damage. Through the use of the filter according to the invention, this situation is prevented because the particles are reliably kept away from the pump chamber. Power losses through the filter are negligible.

In one construction, the front muffler is formed integrally in the form of a ring with a conical frustum-shaped lateral surface molded on the inside. In this way, the sound emissions of the pump are further significantly reduced. Furthermore, the filter can be fastened in a simple way on the lateral surface, e.g., on the end with the smaller diameter.

In another construction, the front muffler is made from an elastic material, e.g., rubber. In this way, a sealing of the front muffler both to the pump chamber and also to the muffler can be easily realized.

In another construction, the filter is fastened in a groove that is formed on an end of the lateral surface with the smaller diameter. In this way, no additional fasteners are required; the installation is simple.

In another construction, the front muffler is held in a clamping manner on an annular web of the muffler. This simplifies the installation. The annular web has, on one peripheral location, a bulge that is directed inward and forms an outlet channel between the annular web and the ring of the front muffler.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

Figure 1:
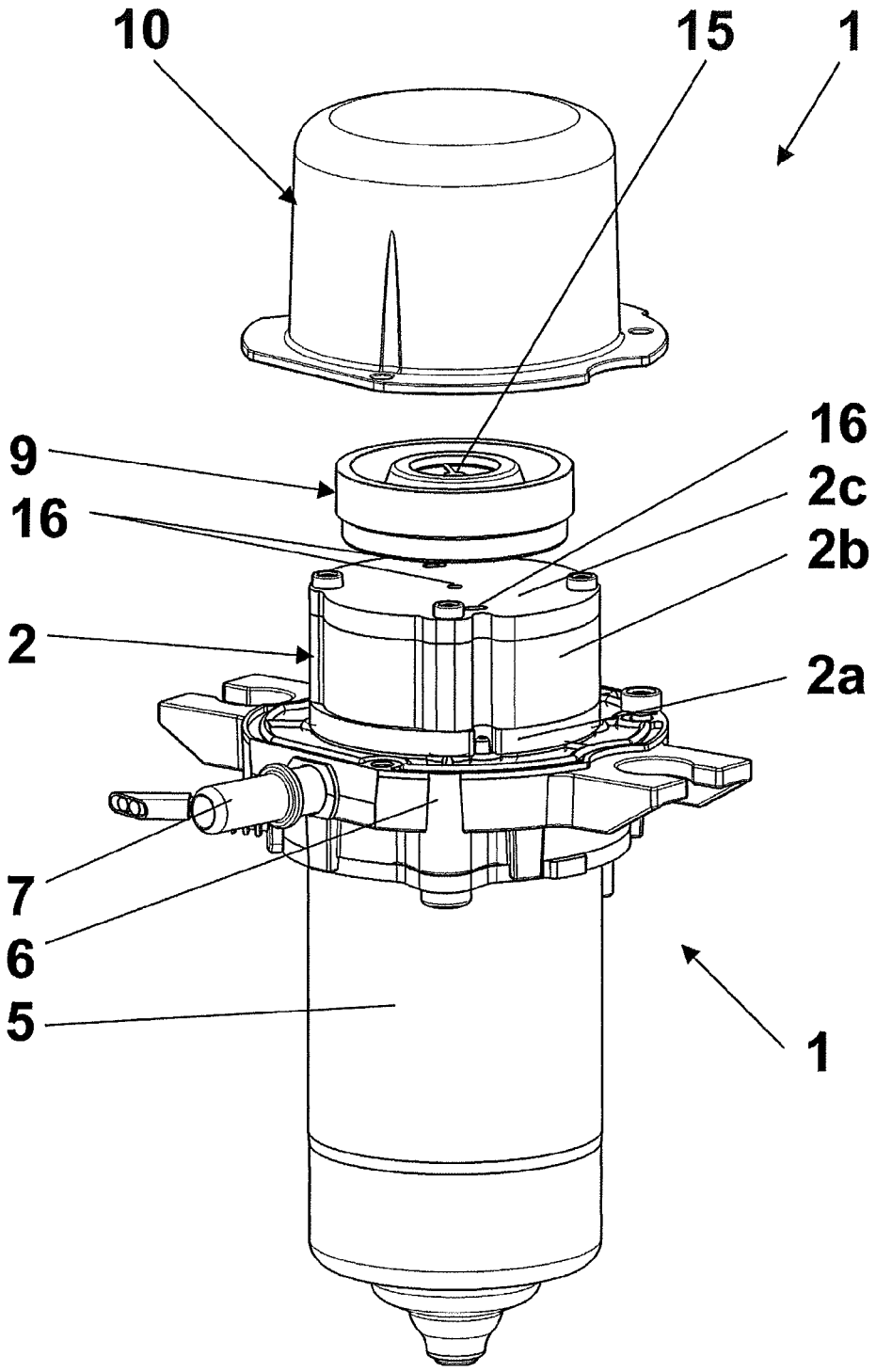
FIG. 1 a partial exploded view of a pump.
Figure 2:
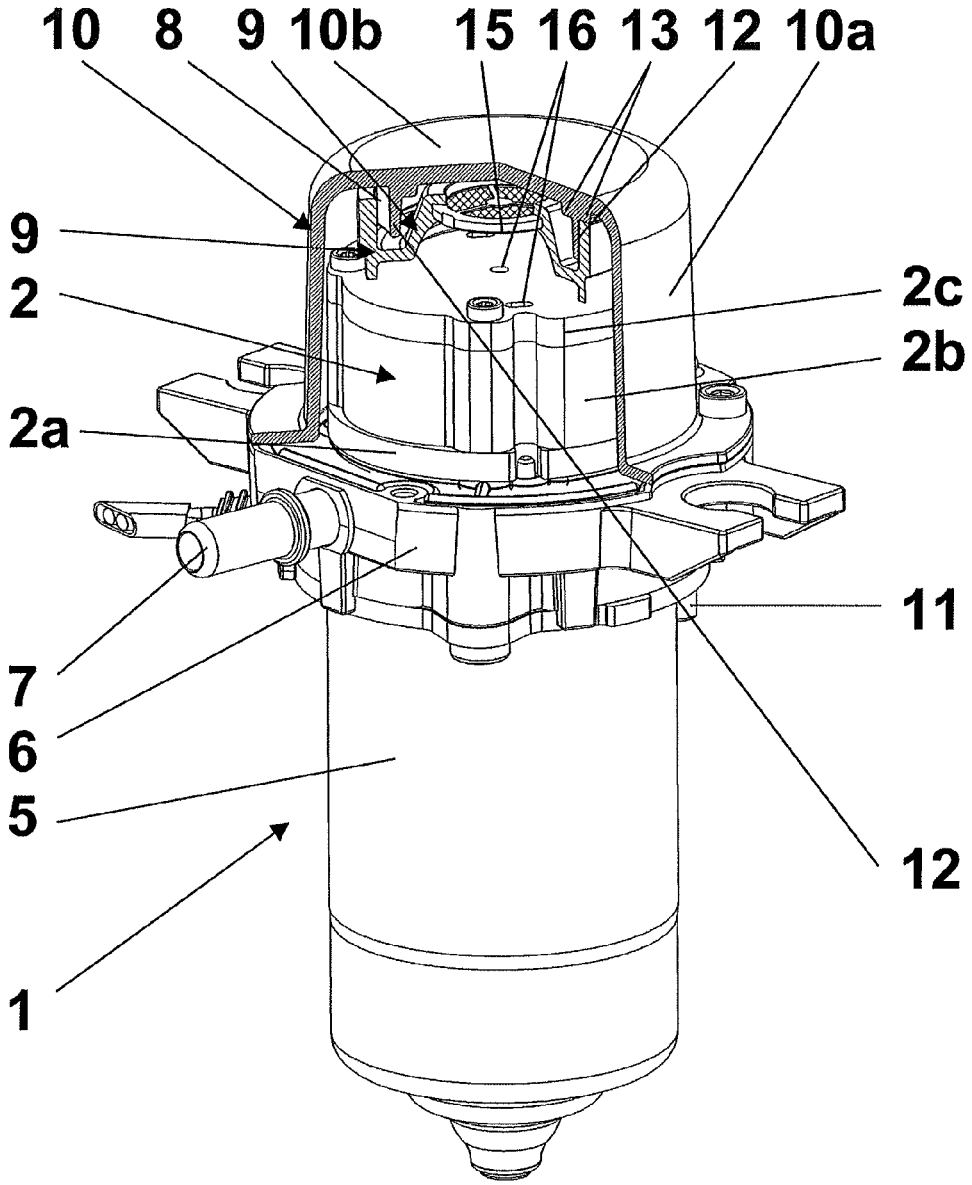
FIG. 2 a partial view of the pump, partially in section.

As can be seen from FIGS. 1 and 2, a pump 1, here a vane cell pump that is defined as a vacuum pump, comprises a pump chamber 2 in which a rotor is supported so that it can rotate. Gates are arranged in the rotor so that they can slide, as usual. The rotor can be driven by means of an electric motor 5 that is fastened to a mounting plate 6. The motor 5 can be surrounded by a housing and is attached to a connecting cable.

The pump chamber 2 is formed from a base plate 2*a*, a pump ring 2*b*, and a cover plate 2*c* and is connected in terms of flow via an inlet channel to an inlet port 7 and via a front muffler 9, an outlet channel 8, and a muffler 10 to an outlet port 11.

Figure 4:
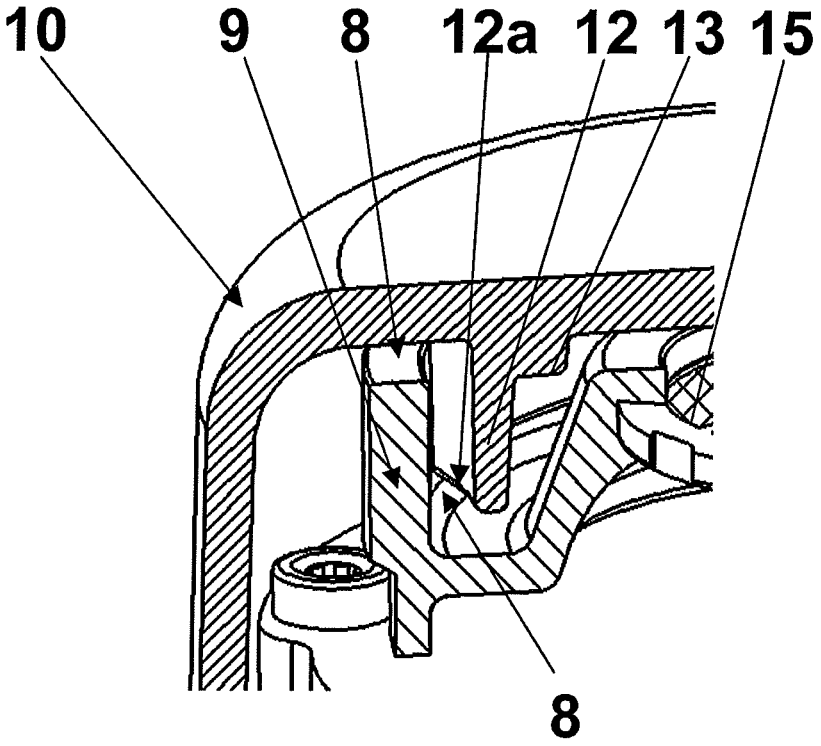
FIG. 4 a perpendicular section through a muffler with the front muffler in the area of an outlet channel as a detail.

The muffler 10 is arranged in the area of the pump chamber 2 so that during operation, air displaced from the pump chamber 2 flows directly into the muffler 10. This muffler here surrounds the pump chamber 2 like a pot such that it encloses a volume for actively damping any noise. As can be seen especially well from FIGS. 2 and 4, the muffler 10 is assembled from an approximately tubular sleeve 10*a* and a base 10*b* attached to it. The largest part of the volume is formed between the cover plate 2*c* and the base 10*b*; a smaller part of the volume is formed as a gap between the pump ring 2*b* and, according to the figures, a lower part of the sleeve 10*a*. In the muffler 10, an annular web 12 on an annular disk 13 is formed on the base 10*b* integrally and concentrically with this base. In cross section, the annular disk 13 is wider than a base of the annular web 12. In top view, the annular web 12 is essentially circular with the exception of a bulge 12*a* directed towards its center. In the area of the bulge 12*a*, the annular disk 13 has a recess in its outer periphery. This recess is formed between this outer periphery, the bulge 12*a*, and the base 10*b*. The muffler 10 is fastened tightly to the mounting plate 6, e.g., by means of screws. It is produced, e.g., from plastic or a lightweight metal alloy.

Figure 3:
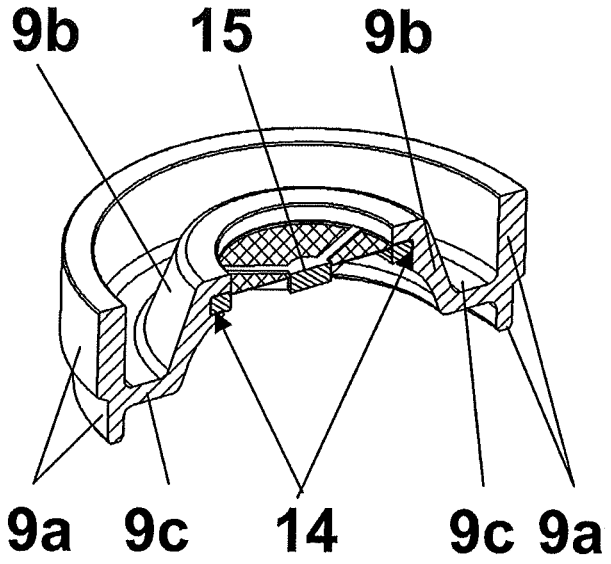
FIG. 3 a perspective-view section of a front muffler with a filter.

The front muffler 9, see, in particular, FIG. 3, is arranged in the volume between the cover plate 2*c* and the base 10*b*. The front muffler 9 has circular symmetry and is formed integrally from a ring 9*a* and a conical frustum-shaped lateral surface 9*b*. In this way, at its lower end that has the greater diameter, the lateral surface 9*b* is fastened indirectly via a connecting disk 9*c* to the ring 9*a* in its lower area. A cross section of the ring 9*a* is constructed thinner in its lower area, here approximately half as thick as in the other area that is here above the connecting disk 9*c*, wherein a chamfered step is formed on the outer periphery of the ring 9*a*; this means that an inner diameter of the ring 9*a* is equal in two areas and thus at the two ends. A height of the ring corresponds to the open spacing—for the completely assembled pump 1—between the cover plate 2*c* and the annular disk 13 plus a minimal clearance. The inner diameter of the ring 9*a* corresponds to an outer diameter of the annular web 12 plus a minimal clearance, so that the ring 9*a* can be fastened in a clamping manner on the annular web 12. An upper end of the lateral surface 9*b* and the end of the ring 9*a* lie in one plane.

In the area of the upper end of the lateral surface 9*b*, a radial annular groove 14 is formed on the inside. A filter 15 is held in the annular groove 14. The filter has an annular disk-shaped frame with braces on which a filter medium, e.g., a fine sieve or a non-woven material is fastened.

The front muffler 9 is made from an elastic material, e.g., rubber or plastic.

The actual pump 1 is produced and assembled as known.

The muffler 10 with the annular web 12 and the annular disk 13, the front muffler 9 and the filter 15 (filter medium simultaneously molded) are produced, e.g., using injection molding. The filter 15 is inserted into the annular groove 14 and thus fastened in a clamping manner. The front muffler 9 with the inserted filter 15 is fastened in a clamping manner in the muffler; for this purpose, the upper end of the ring 9*a* is pushed over the annular web 12 until it contacts the annular disk 13. In this way, the outlet channel 8 is formed between the ring 9*a* and the bulge 12*a* and also through the recess between the ring 9*a* and the base 10*b*. The muffler 10 with the mounted muffler 9 is put over the pump chamber 2 and fastened on the mounting plate 6. In this way, the ends of the ring 9*a* are pressed lightly against the cover plate 2*c* and against the annular disk 13 with a sealing effect—with an exception in the area of the recess. In this way, two separate volumes that are connected in terms of flow only through the outlet channel 8 are produced for damping any noise.

The pump 1 produced in this way is fastened in a vehicle, connected electrically, and connected to a hose line on each inlet port 7 and outlet port 11.

During operation, the motor 5 is supplied with power and drives the rotor. In this way, air is suctioned through the inlet port 7 with the first hose and a low pressure that is needed on a load is generated. The suctioned air is compressed in the pump chamber 2 and led through a pressure system—namely through drill holes 16 in the cover plate 2*c*, through the front muffler 9 and here through the filter 15, then through the outlet channel 8, the muffler 10, the outlet port 11, and the second hose—into the surroundings.

When the pump 1 is turned off, low pressure is established in the load, the first hose, and the inlet port 7. This is equalized by suctioning air from the surroundings through the pressure system. This air can contain particles that can reach into the pump chamber 2. Through the filter 15, the particles are reliably separated from the pump chamber 2 so that they can do no damage. When the pump 1 is next operated, the filter 15 is automatically cleaned by the air flowing in the normal direction again.

The sound damping of the pump 1 during operation is greatly improved due to the new construction of the front muffler 9. On one hand, pressure impacts are damped by the elastic material. On the other hand, the volume in the muffler 10 is divided by the front muffler 9 into several sub-volumes, which contributes significantly to the sound damping due to the multiple deflections of the flow.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

LIST OF REFERENCE SYMBOLS

1 Pump
2 Pump chamber
2*a* Base plate
2*b* Pump ring
2*c* Cover plate
3
4
5 Motor
6 Mounting plate
7 Inlet port
8 Outlet channel
9 Front muffler
9*a* Ring
9*b* Lateral surface
9*c* Connecting disk

10 Muffler
10*a* Sleeve
10*b* Base
11 Outlet port
12 Annular web
12*a* Bulge
13 Annular disk
14 Annular groove
15 Filter
16 Drill hole

The invention claimed is:

1. A pump, comprising:
a pump chamber,
a rotor with gates supported in said pump chamber so that said rotor can rotate,
an electric motor operable for driving the rotor,
a muffler that encloses a volume in the area of the pump chamber, wherein the volume is in active connection with an outlet port,
a front muffler that is arranged within the muffler,
a filter integrated into the front muffler,
wherein the front muffler is formed in a ring with a conical frustum-shaped lateral surface molded on the inside, and
wherein the filter is fastened in an annular groove formed on an end of the lateral surface with a smaller diameter.

2. The pump according to claim 1, wherein the front muffler is made from an elastic material.

3. The pump according to claim 1, wherein the front muffler is held in a clamping manner on an annular web of the muffler.

4. A pump, comprising:
a pump chamber,
a rotor with gates supported in said pump chamber so that said rotor can rotate,
an electric motor operable for driving the rotor,
a muffler that encloses a volume in the area of the pump chamber, wherein the volume is in active connection with an outlet port,
a front muffler that is arranged within the muffler,
a filter integrated into the front muffler, and
wherein the front muffler is held in a clamping manner on an annular web of the muffler.

5. The pump according to claim 4, wherein the front muffler is formed in a ring with a conical frustum-shaped lateral surface molded on the inside.

6. The pump according to claim 4, wherein the front muffler is made from an elastic material.

7. The pump according to claim 5, wherein the filter is fastened in an annular groove formed on an end of the lateral surface with a smaller diameter.

* * * * *